United States Patent [19]

Meister et al.

[11] 4,207,829

[45] Jun. 17, 1980

[54] TOWABLE SWIMMER-CONTROLLED AQUATIC PLANE DEVICE

[75] Inventors: Robert L. Meister, 4404 Old Mill Rd., Ft. Wayne, Ind. 46807; Monte A. Orr, Roswell, N. Mex.

[73] Assignee: Robert L. Meister, Fort Wayne, Ind.

[21] Appl. No.: 927,545

[22] Filed: Jul. 24, 1978

[51] Int. Cl.[2] ..... B63G 8/00

[52] U.S. Cl. ..... 114/245; 114/315

[58] Field of Search ..... 244/91; 114/315, 244, 114/245, 274; 115/6, 6.1, 7

[56] References Cited

U.S. PATENT DOCUMENTS

| | | | |
|---|---|---|---|
| 2,948,251 | 8/1960 | Replogle | 114/245 |
| 3,039,415 | 6/1962 | Foster | 114/245 |
| 3,084,653 | 4/1963 | Lepine | 114/245 |
| 3,107,640 | 10/1963 | Lepine | 114/245 |
| 3,139,055 | 6/1964 | Nutting | 114/245 |
| 3,163,148 | 12/1964 | Duren | 114/245 |
| 3,261,318 | 7/1966 | Jones | 114/245 |
| 3,625,172 | 12/1971 | Gilster | 114/245 |
| 3,638,598 | 2/1972 | Vlad | 114/245 |
| 3,883,092 | 5/1975 | Ditto | 244/91 |
| 3,931,777 | 1/1976 | Colgan | 114/245 |

FOREIGN PATENT DOCUMENTS

| | | | |
|---|---|---|---|
| 141788 | 8/1960 | U.S.S.R. | 114/315 |

*Primary Examiner*—Trygve M. Blix
*Assistant Examiner*—D. W. Keen
*Attorney, Agent, or Firm*—Gust, Irish, Jeffers & Hoffman

[57] ABSTRACT

A towable, swimmer-controlled, aquatic plane device includes an elongated wing element having sections symmetrical about a transverse center line and a fin element also having sections symmetrical about a transverse center line, the fin element being removably attached at its transverse center line to the wing element at its transverse center line with the fin element sections extending vertically above and below the wing element. Openings are provided in each fin element section adjacent its leading edge and adjacent the wing element for attaching a tow rope. Openings are provided in each fin element adjacent its trailing edge which form hand grip portions by which a swimmer can steer the device in any one or more of four directions, i.e., down for diving, up to plane on the surface of the water, or banking for turning left or right.

17 Claims, 9 Drawing Figures

TOWABLE SWIMMER-CONTROLLED AQUATIC PLANE DEVICE

BACKGROUND OF THE INVENTION

1. Field of the Invention

This invention relates generally to towable, swimmer-controlled, aquatic plane devices.

2. Description of the Prior Art

In the field of aquatic recreational products, various types of boat-towable, swimmer-controlled, plane devices have been proposed, those shown in U.S. Pat. Nos. 3,039,415; 3,261,318; 2,948,251; and 3,163,148 being fairly typical. However, prior devices of this general type known to the present applicant have suffered one or more defects, i.e., cost, complexity, lack of steerability in four directions, and/or lack of the capability to be readily disassembled for portability and storage.

It is therefor desirable to provide a towable, swimmer-controlled, aquatic plane device characterized by its simplicity and relatively low cost, ease of assembly and disassembly for transportation and storage, and steerability in any one or more of four directions.

SUMMARY OF THE INVENTION

The invention, in its broader aspects, provides a towable, swimmer-controlled, aquatic plane device comprising an elongated wing element having substantially symmetrical sections on opposite sides of a transverse center line and a fin element also having substantially symmetrical sections on opposite sides of a transverse center line. Means are provided for removably attaching the wing element at its center line to the fin element at its center line so that the symmetrical sections of the fin element extend vertically above and below the wing element. One of the elements has means thereon for attaching a tow rope, and each of the fin element sections has an opening therein defining a hand grip portion adapted to be gripped by a swimmer for controlling the device.

It is accordingly an object of the present invention to provide an improved towable, swimmer-controlled, aquatic plane device.

Another object of the invention is to provide an improved towable, swimmer-controlled aquated plane device characterized by its simplicity, ease of assembly and disassembly, and steerability in any one or more of four directions.

The above-mentioned and other features and objects of this invention and the manner of attaining them will become more apparent and the invention itself will be best understood by reference to the following description of an embodiment of the invention taken in conjunction with the accompanying drawings.

DESCRIPTION OF THE PREFERRED EMBODIMENTS

Figure 1:
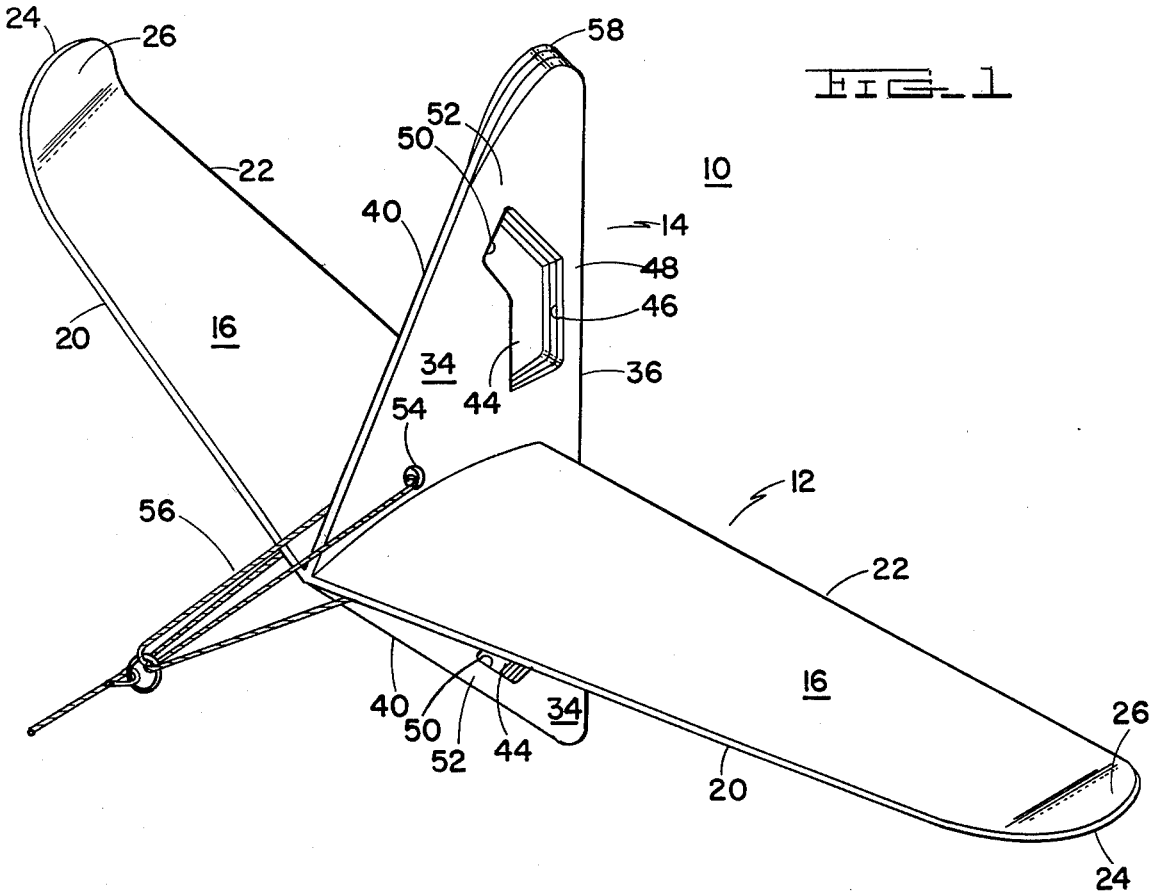
FIG. 1 is a view in perspective showing one embodiment of the invention.
Figure 2:
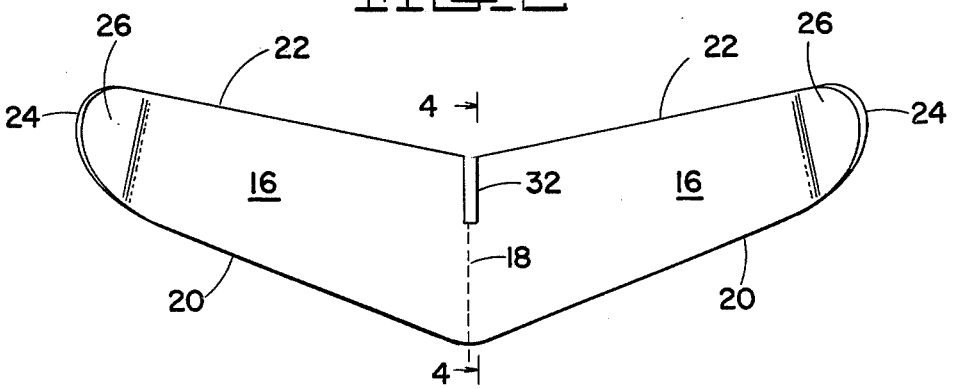
FIG. 2 is a top plan view of the wing element of the embodiment of FIG. 1.
Figure 3:
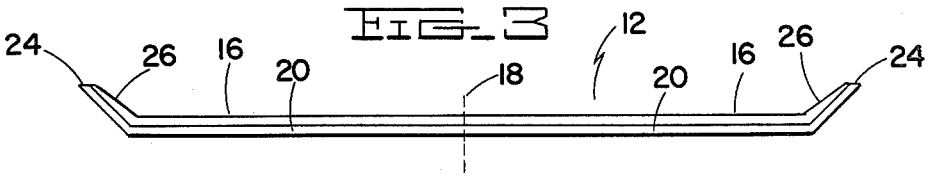
FIG. 3 is a front view of the wing element of FIG. 2.
Figure 4:
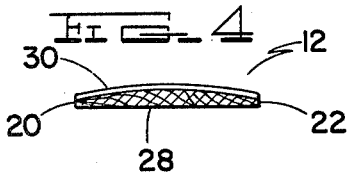
FIG. 4 is a cross-sectional view taken generally along the line 4—4 of FIG. 3.

Referring now to FIGS. 1–6 of the drawings, the improved boat-towable, swimmer-controlled, aquatic plane device of the invention, generally indicated at 10, comprises elongated wing element 12 and vertical fin element 14 removably attached to wing element 12 as will be hereinafter described. Wing element 12 has symmetrical sections 16 on opposite sides of transverse center line 18. Each section 16 of wing element 12 has leading edge 20 and trailing edge 22 which converge or tapper toward rounded tip 24. In the preferred embodiment, as best seen in FIG. 4, each tip 24 is inclined upwardly to define areas 26 of increased dihedral. As best seen in FIG. 3, sections 16 of wing element 12 are preferably swept-back as shown. In a preferred embodiment, bottom surface 28 of wing element 12 is flat whereas top surface 30 is curved to form a flat airfoil, as best seen in FIG. 4. Slot 32 extends forwardly from trailing edge 22 of wing 12 on center line 18 toward leading edge 20 for a purpose to be described. Wing element 12 may be formed of any suitable material having sufficient buoyancy to be floatable, such as compressed fiberboard preferably with a hardened surface lamination for appearance and to inhibit denting of the wing element.

Figure 6:
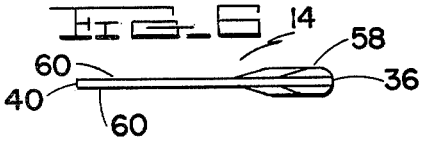
FIG. 6 is a top view of the fin element of FIG. 5 viewed generally along the line 6—6 thereon.
Figure 5:
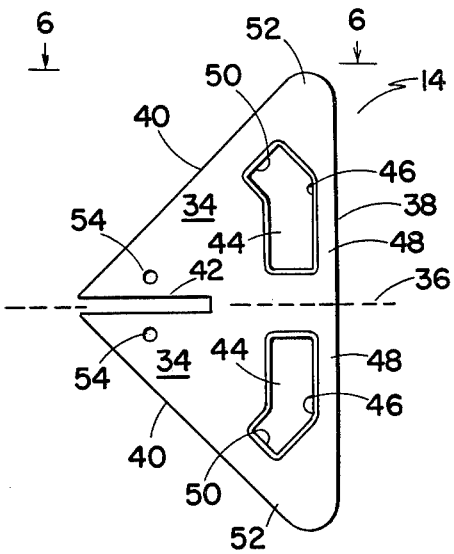
FIG. 5 is a side view of the fin element of the embodiment of FIG. 1.

Referring particularly to FIGS. 5 and 6 in addition to FIG. 1, fin element 14 similarly has symmetrical sections 34 on opposite sides of transverse center line 36. Fin element 14 has trailing edge 38 and each section 34 has leading edge 40 inclined outwardly and rearwardly toward trailing edge 38 generally to define a triangular configuration. Slot 42 extends rearwardly from the apex of leading edges 40 on center line 36 toward trailing edge 38.

It will now be understood that slot 42 of fin 14 receives the portion of wing element 12 on center line 18 thereof forwardly of slot 32 and likewise, that slot 32 in wing element 12 receives the portion of fin element 14 on center line 36 rearwardly of slot 42 thereby to provide a removable, interfitting connection of fin element 14 with wing element 12. It will be seen that trailing edge 36 of fin element 14 extends vertically with respect to wing element 12 and is spaced rearwardly from trailing edge 22 of wing element 12. Fin element sections 34 extend vertically above and below wing element 12 and their leading edges 40 extend upwardly and rearwardly, and downwardly and rearwardly, respectively, from leading edge 20 of wing element 12.

Each section 34 of fin element 14 has opening 44 formed therein. Each opening 44 has rear edge 46 spaced from and parallel with trailing edge 38 to define hand grip portion 48 therewith. Each opening 44 also has edge 50 spaced and parallel with leading edge 40 of the respective section 34 thereby to provide another hand grip portion 52. Each section 34 of fin element 14 has opening 54 therein closely spaced from slot 42 and wing element 12 and spaced rearwardly from leading edge 40 for receiving tow rope 56, as best seen in FIG.

1. Fin element 14 preferably has a bulbous portion 58 adjacent trailing edge 36 which merges into flat opposite sides 60 extending toward leading edge 40, as best seen in FIG. 6. Bulbous portion 58 provides a thickened hand grip portion 48. Fin element 14 also may be formed of any suitable material having flotation properties, such as compressed fiberboard preferably having surface laminations formed of harder material.

It will now be seen that a swimmer can be towed by plane device 10 which, in turn, is towed by a boat (not shown) by means of tow rope 56, the swimmer grasping with his hands either hand grip portions 50 adjacent trailing edge 36, or hand grip portions 52 adjacent leading edges 40 of fin element 14. By thus gripping fin element 10 at two points respectively above and below plane element 12, the swimmer can tilt device 10 downwardly for diving, upwardly to return to surface and plane thereon, the blank device 10 to the left or to the right for steering in that direction. Grasping fin element 10 by hand grip portions 52 increases the leverage for banking the device in either direction.

Figure 8:
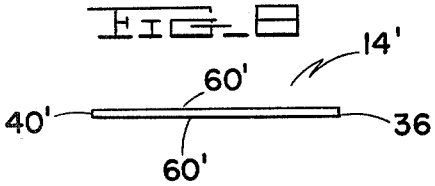
FIG. 8 is a top view of the fin element of FIG. 7 viewed generally along the line 8—8 thereof.
Figure 7:
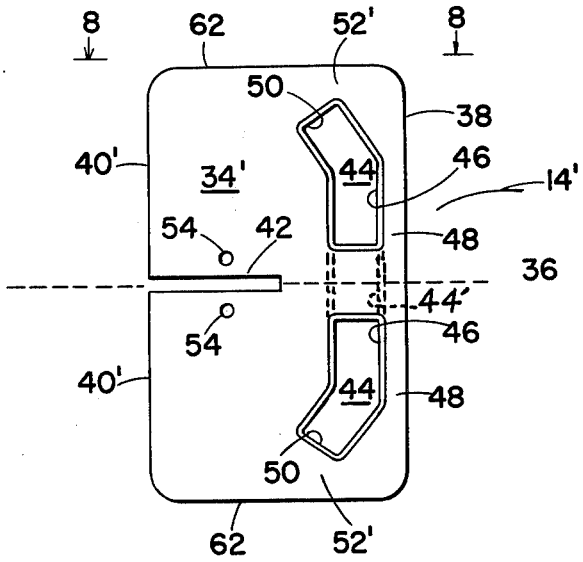
FIG. 7 is a side view of a modified form of fin element.

Referring now to FIGS. 7 and 8 in which like elements are indicated by like reference numerals, fin element 12 may be substantially rectangular with trailing edge 38 and leading edges 40' being parallel and respectively joining top and bottom edges 62. Fin element 14' is removably connected to wing element 12 in the same manner as described above in connection with fin element 14, leading edges 40' extending upwardly and downwardly, respectively, from leading edge 20 and trailing edge 38 being spaced rearwardly from trailing edge 22 of wing element 12. As seen in FIG. 8, bulbous portion 58 shown in FIGS. 1 and 6 may be eliminated so that fin element 14' has flat opposite sides 60' extending between leading edges 40' and trailing edge 36. It will be understood that fin element 14 of FIG. 5 may also have bulbous portion 58 eliminated to provide flat opposite sides 60'. Further, either fin element 14 or 14' may have openings 44 which are rectangular or of some other configuration which merely provide hand grip portions 48, but do not provide hand grip portions 52.

The handle openings 44, alternatively to that described thus far may be connected together to form only a single, elongated opening 44' as shown in full and dashed lines in FIG. 7. A swimmer may grasp with one hand only the handle 48 in or near the plane of the wing element 16 by passing his fingers through the opening 44' just aft of wing element 16 and thereby be towed along on the surface of the water, the wing element 16 being caused to ride the surface. The swimmer's other hand would thus be free to fend off, to hold a spear gun or to perform some other activity.

Figure 9:
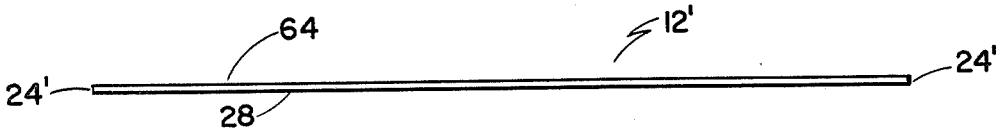
FIG. 9 is a front view of a modified form of wing element.

Referring briefly to FIG. 9, wing element 12' may have substantially flat top and bottom sides 64, 28 and the inclined tips 24 shown in FIGS. 1, 2 and 3 may be eliminated so that wing element 12' is essentially planar terminating in tips 24'.

While there have been described above the principles of this invention in connection with specific apparatus, it is to be clearly understood that this description is made only by way of example and not as a limitation to the scope of the invention.

What is claimed is:

1. A towable, swimmer-controlled, aquatic plane device comprising: an elongated wing element having substantially symmetrical sections on opposite sides of a transverse centerline; a fin element having sections on opposite sides of a transverse centerline; means for removably attaching said wing element at said centerline thereof to said fin element at said centerline thereof with said symmetrical sections thereof respectively extending substantially vertically above and below said wing element; said means comprises a slot in one of said wing and fin elements extending forwardly from said trailing edge thereof substantially along said centerline thereof, and a slot in the other of said wing and fin elements extending rearwardly from the leading edge thereof substantially along the centerline thereof, the slot in said one of said elements receiving the other element forwardly of the slot in the latter and the slot in the other element receiving said one element rearwardly of the slot in the latter to provide an interfitting connection; said other of said elements having means for attaching a tow rope thereto whereby a pulling force on said other element retains said one element assembled thereto; said fin element sections having an opening therein defining a hand grip portion adapted to be gripped by a swimmer for controlling said device.

2. The device of claim 1 wherein said wing element has a leading edge, said fin element sections respectively having leading edges extending upwardly and downwardly from said wing element leading edge.

3. The device of claim 1 wherein said fin element is generally rectangular.

4. The device of claim 1 wherein said wing element and said fin element respectively have leading and trailing edges, said trailing edge of said fin element being spaced rearwardly from said trailing edge of said wing element.

5. The device of claim 1 wherein said wing element and fin element respectively have leading and trailing edges, said fin element sections being substantially symmetrical and each having an opening provided with edges closely spaced from and parallel with said fin element trailing edge thereby defining said hand grip portions.

6. The device of claim 5 wherein each of said fin element openings has another edge closely spaced from another edge of the respective fin element section thereby to define another hand grip portion.

7. The device of claim 1 wherein said wing element and fin element respectively have leading and trailing edges, said fin element having a bulbous portion adjacent said trailing edge thereof merging into substantially flat opposite sides extending forwardly to said leading edge thereof.

8. The device of claim 1 wherein each of said wing element sections has top and bottom surfaces and an outer tip, each of said tips being inclined upwardly to provide an area of increased dihedral adjacent thereto.

9. The device of claim 1 wherein said wing element and fin element respectively have leading and trailing edges, said tow rope attaching means comprising a tow rope receiving aperture in each of said fin sections rearwardly from said leading edge thereof and adjacent said wing element.

10. The device of claim 1 wherein each wing element section has leading and trailing edges which taper outwardly toward each other to a tip, each wing element section being swept-back.

11. The device of claim 1 wherein said wing element and fin element respectively have leading and trailing edges, the trailing edge of said fin element being substantially straight and vertical with respect to said wing element and spaced rearwardly from the trailing edge thereof, the leading edge of each fin element section being inclined upwardly and rearwardly from the leading edge of said wing element toward the trailing edge of said fin element to define a generally triangular fin section, said fin element opening having portions extending above and below said wing element and edges closely spaced from and parallel with said fin element trailing edge to define hand grip portions, said portions being elongated with the upper-most and lower-most portions being angled forwardly and having transverse edges which provide other hand grip portions, said towing rope attaching means comprising an aperture in each said other element rearwardly of the respective leading edge thereof and adjacent said one element.

12. The device of claim 1 wherein said wing element and fin element respectively have leading and trailing edges, the trailing edge of said fin element being substantially straight and vertical with respect to said wing element and spaced rearwardly from the trailing edge thereof, said fin element being substantially rectangular with the leading edges of said sections thereof extending respectively vertically upwardly and downwardly from the leading edge of said wing element, each said fin element opening having an edge closely spaced from and parallel with said fin element trailing edge to define said hand grip portion, each said fin element opening having another edge closely spaced from the outer edge of the respective fin element section to define another hand grip portion, said towing rope attaching means comprising an aperture in each said fin section adjacent the respective leading edge thereof and adjacent said wing section.

13. The device of claim 11 or claim 12 wherein each said wing section has the leading and trailing edges thereof tapered outwardly toward a tip, each wing element section being swept-back, the tip of each wing element section being inclined upwardly to define an area of increased dihedral adjacent thereto.

14. The device of claim 11 or claim 12 wherein said wing element has top and bottom surfaces, said bottom surface being substantially flat and said top surface being outwardly curved in the transverse direction to form a flat airfoil.

15. The devices of claim 11 or claim 12 wherein said fin element has a bulbous portion adjacent said trailing edge thereof merging into substantially flat opposite sides extending forwardly to said leading edge thereof.

16. The device of claim 1 wherein said wing element and fin element respectively have leading and trailing edges, said fin opening extending from one fin section to the other fin section and having an edge closely spaced from and parallel with the trailing edge of said fin element thereby defining hand grip portions.

17. The device of claim 16 wherein the opposite ends of said fin element opening has another edge closely spaced from another edge of the respective fin element section thereby to define other hand grip portions.

* * * * *

UNITED STATES PATENT AND TRADEMARK OFFICE

CERTIFICATE OF CORRECTION

PATENT NO. : 4,207,829

DATED : June 17, 1980

INVENTOR(S) : Robert L. Meister, Monte A. Orr

It is certified that error appears in the above-identified patent and that said Letters Patent are hereby corrected as shown below:

Column 3, line 18 - Change "the blank" to --and bank--

Claim 1, Column 4, line 5 - Change "comprises" to --comprising--

Signed and Sealed this

*Sixteenth* Day of *September 1980*

[SEAL]

*Attest:*

SIDNEY A. DIAMOND

*Attesting Officer*

*Commissioner of Patents and Trademarks*